US009708040B2

(12) United States Patent
Le Devehat et al.

(10) Patent No.: US 9,708,040 B2
(45) Date of Patent: Jul. 18, 2017

(54) SYSTEM FOR TRANSFERRING A FLUID PRODUCT AND ITS IMPLEMENTATION

(75) Inventors: Renaud Le Devehat, Thorigny sur Oreuse (FR); Eric Morilhat, Pont sur Vanne (FR)

(73) Assignee: FMC Technologies, S.A., Sens (FR)

( * ) Notice: Subject to any disclaimer, the term of this patent is extended or adjusted under 35 U.S.C. 154(b) by 0 days.

(21) Appl. No.: 13/138,289

(22) PCT Filed: Jan. 27, 2010

(86) PCT No.: PCT/IB2010/000419

§ 371 (c)(1),
(2), (4) Date: Jul. 26, 2011

(87) PCT Pub. No.: WO2010/086749

PCT Pub. Date: Aug. 5, 2010

(65) Prior Publication Data

US 2011/0277845 A1 Nov. 17, 2011

(30) Foreign Application Priority Data

Jan. 27, 2009 (FR) ..... 09 50492

(51) Int. Cl.
*B63B 27/24* (2006.01)
*B67D 9/02* (2010.01)

(52) U.S. Cl.
CPC ..... *B63B 27/24* (2013.01); *B67D 9/02* (2013.01); *Y10T 137/0318* (2015.04); *Y10T 137/3802* (2015.04); *Y10T 137/8807* (2015.04)

(58) Field of Classification Search
USPC ..... 137/615, 899.2; 441/4; 414/137.1, 414/137.9; 141/382, 387; 114/144 B
See application file for complete search history.

(56) References Cited

U.S. PATENT DOCUMENTS

| | | | | |
|---|---|---|---|---|
| 1,680,831 | A * | 8/1928 | White | 137/615 |
| 3,085,593 | A * | 4/1963 | Sorensen | 137/615 |
| 3,249,121 | A * | 5/1966 | Bily | 137/615 |
| 3,340,907 | A * | 9/1967 | Bily | B67D 9/02 137/615 |

(Continued)

FOREIGN PATENT DOCUMENTS

| | | |
|---|---|---|
| EP | 0 947 464 A1 | 10/1999 |
| WO | WO 99/35031 A1 | 7/1999 |

*Primary Examiner* — Kevin Murphy
*Assistant Examiner* — Jonathan Waddy

(57) ABSTRACT

The invention relates to a system for transfer of a fluid product and its use, comprising at least one tubular arrangement for conveying the product between two locations and having two segments (2*a*, 2*b*) articulated to each other by a first of their ends, the opposite end of a first of the two segments being rotatably suspended from a support arm (1) adapted to be installed at one of the two locations and the opposite end of the second segment being able to be connected to a coupling means adapted to be installed at the second location, first means (13, 15) for turning the first segment (2*a*) relative to the arm, for the purpose of lowering its first end from a storage position on the same side as the support arm and second means (33,11) for pulling up the end of the second segment (2*b*) which end is adapted to be linked to the coupling means for the purpose of connecting that end to the coupling means (6) from underneath.

20 Claims, 14 Drawing Sheets

(56) References Cited

U.S. PATENT DOCUMENTS

| | | | | | |
|---|---|---|---|---|---|
| 3,372,715 | A * | 3/1968 | Ashton | B67D 7/002 | 137/615 |
| 4,084,247 | A * | 4/1978 | Ball | G06G 7/22 | 141/387 |
| 4,114,662 | A * | 9/1978 | Goodacre | B67D 9/02 | 137/615 |
| 4,205,308 | A * | 5/1980 | Haley | B25J 9/1676 | 137/556 |
| 4,206,782 | A | 6/1980 | Tuson | | |
| 4,261,398 | A * | 4/1981 | Haley | 141/387 | |
| 4,408,943 | A * | 10/1983 | McTamaney et al. | 137/899.2 | |
| 4,418,718 | A * | 12/1983 | Fusy | B63B 27/24 | 137/615 |
| 6,343,620 | B1 | 2/2002 | Le Devehat et al. | | |
| 6,434,948 | B1 | 8/2002 | Eide et al. | | |
| 6,637,479 | B1 * | 10/2003 | Eide | F16L 39/00 | 114/230.1 |
| 6,886,611 | B2 | 5/2005 | DuPont et al. | | |
| 7,007,623 | B2 * | 3/2006 | Boatman | B63B 27/24 | 114/230.15 |
| 2004/0154697 | A1 * | 8/2004 | Dupont et al. | 141/382 | |
| 2007/0289517 | A1 * | 12/2007 | Poldervaart et al. | 114/230.15 | |

* cited by examiner

SYSTEM FOR TRANSFERRING A FLUID PRODUCT AND ITS IMPLEMENTATION

BACKGROUND OF THE INVENTION

The invention concerns a system for transferring a fluid product, liquefied natural/gas (LNG) for example, between two ships on the open sea, of which the first may be a producer ship, such as an LNG-P (acronym for "Liquefied Natural Gas—Producer"), also termed LNG-FPSO (acronym for "Liquefied Natural Gas—Floating Production, Storage and Offloading"), a re-liquefaction ship (FSRU), a GBS (Gravity Base Structure, that is to say having a weighted base) or a platform, and the second adapted to receive the gas or any other fluid product for its transport, such as a tanker or an LNG-C (acronym for "Liquefied Natural Gas—Carrier").

Various systems for offshore transfer between two ships linked in tandem exist, and may be classified into three categories, which are:

- systems with hinged rigid piping, such as those described in the patent applications WO2004094296, WO0066484, WO0316128, and WO01004041;
- systems with concentric double piping, such as that described for example in the patent application WO9950173 and in the document OTC 14099 "tandem mooring LNG offloading system", by L. Poldervaart, J. P. Queau and Wim Van Wyngaarden and presented at the "Offshore Technology Conference" in Houston, Tex., USA (6-9 May 2002); and
- systems using flexible piping (cryogenic hoses), such as those described in patent application WO03037704 or in the document OTC 14096 entitled "A new solution for tandem offloading of LNG", by Jurgen Eide, Svein I. Eide, Arild Samuelsen, Svein A. Lotceit and Vidar Hanesland and presented at the "Offshore Technology Conference" in Houston, Tex., USA (6-9 May 2002).

SUMMARY OF THE INVENTION

The present invention generally relates to a provision making it simpler to perform the transfer of a fluid product and furthermore leading to other advantages.

To that end, the invention relates to a system for transfer of a fluid product, in particular liquefied natural gas, comprising at least one tubular arrangement for conveying the fluid product between two locations and having two segments articulated to each other by a first of their ends, the opposite end of a first of the two segments being rotatably suspended from a support arm adapted to be installed at a first of the two locations and the opposite end of the second segment being able to be connected to a coupling means installed at the second location, and first means for turning the first segment relative to the support arm, for the purpose of lowering its first end from a storage position on the same side as the support arm, characterized in that it comprises second means for pulling up the end of the second segment which end is adapted to be linked to the coupling means for the purpose of connecting that end to the coupling means from underneath.

Such provisions make it possible to implement a transfer system not requiring balancing or a constant-tension winch to avoid shocks on connection.

According to advantageous provisions of the invention, which may be combined:

- the segments are produced in the form of rigid pipes.

- the first means comprise a first cable linked to the first end of the first segment and winding means for that first cable.
- the winding means for the first cable comprise a winch mounted on the support arm.
- the second means comprise a second cable and winding means for that cable.
- the winding means for the second cable comprise a winch adapted to be installed at the second location.
- in the storage position of each tubular arrangement, its second segment is oriented such that its end that is able to be connected to the coupling means is situated in the neighborhood of the base of a support structure carrying the support arm.
- the support arm is carried by a support structure adapted pivot about a vertical axis.
- the second segment comprises a plug valve at its free end for its connection to the coupling means.
- the system comprises at least six rotary joints enabling the movements of the tubular arrangement.
- the number of rotary joints is equal to seven, and the system further comprises a device for damping oscillations of the rotary joints that may occur.
- the system comprises a battery of several tubular arrangements arranged in parallel and suspended from the support arm.
- the first location is formed by a production or regasification platform or ship and the second location is formed by a transport ship.
- each tubular arrangement comprises end of travel switches to limit the angular travel of the first and second segments relative to each other.

The invention also concerns a combination comprising a system as defined above and a coupling means provided with means for fixing to the second location.

According to particular provisions relative to this combination.

- each tubular arrangement comprises, at the free end of its second segment, a frusto-conical member, and the coupling means comprises a complementary frusto-conical member, such that the two frusto-conical members can nestingly fit together to define a relative position of said system and of the coupling means.
- the coupling means is a valve/coupler.

The invention also concerns an assembly comprising several systems as defined above.

The invention also concerns a method for transfer of a fluid product, in particular liquefied natural gas, with a system for transfer of a fluid product comprising at least one tubular arrangement for conveying the fluid product between two locations having two segments articulated to each other by a first of their ends, the opposite end of a first of the two segments being rotatably suspended from a support arm adapted to be installed at a first of the two locations and the opposite end of the second segment being able to be connected to a coupling means adapted to be installed at the second location, the method comprising the steps consisting of:

- turning the first segment relative to the support arm, for the purpose of lowering its first end from a storage position on the same side as the support arm;
- pulling up the end of the segment adapted to be linked to the coupling means for the purpose of connecting that end to the coupling means from underneath.

Other features and advantages of the invention appear in light of the following description of embodiments that are provided by way of non-limiting example, the description being made with reference to the accompanying drawings.

It should be noted that the different views are diagrammatic or even very diagrammatic representations, and certain elements have been omitted from certain Figures for reasons of clarity.

DETAILED DESCRIPTION OF THE INVENTION

Figure 1:
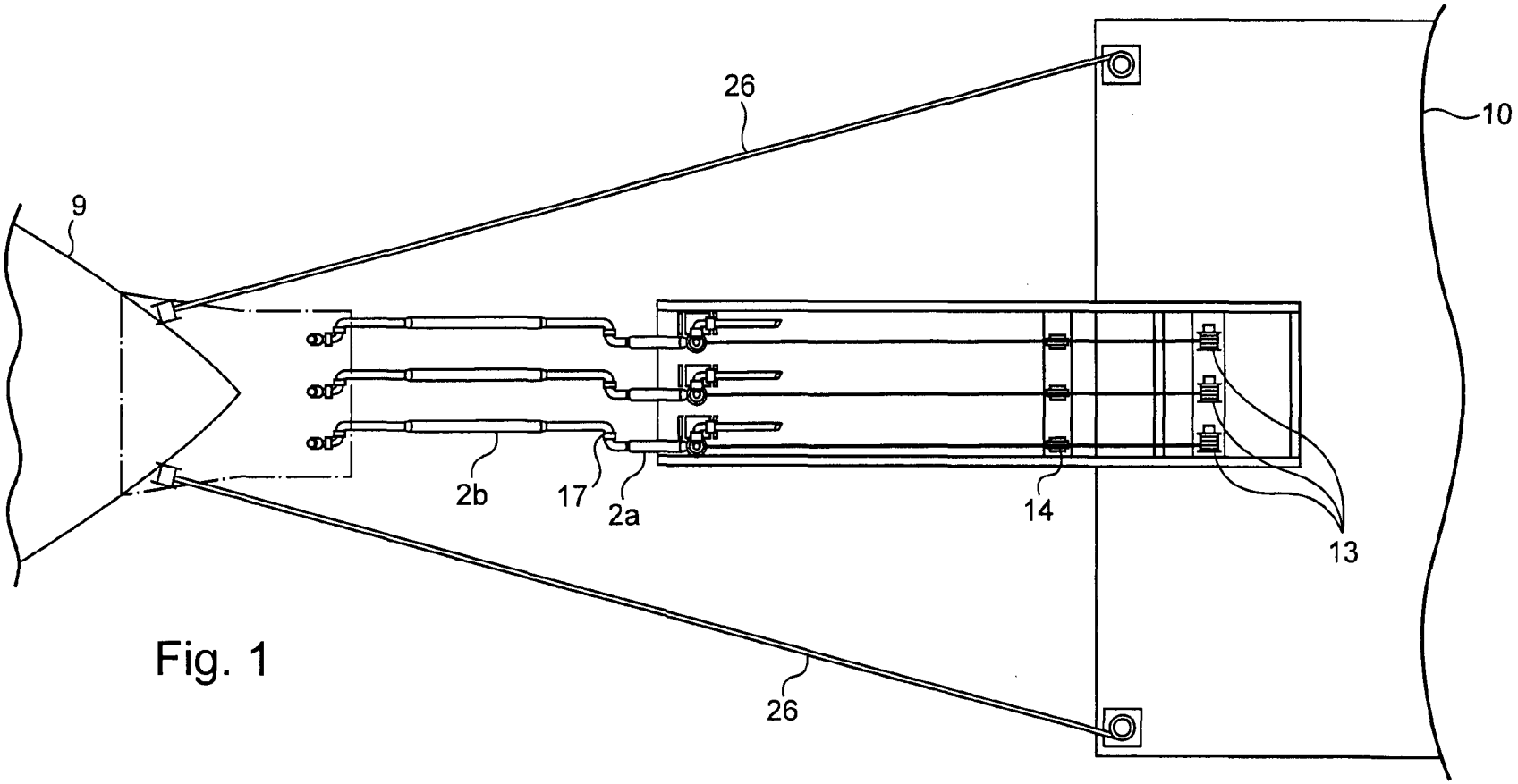
FIGS. 1 and 2 are respectively general views from above and in elevation of a transfer system in accordance with the invention and that is equipped with three identical tubular arrangements in connection position.
Figure 2:
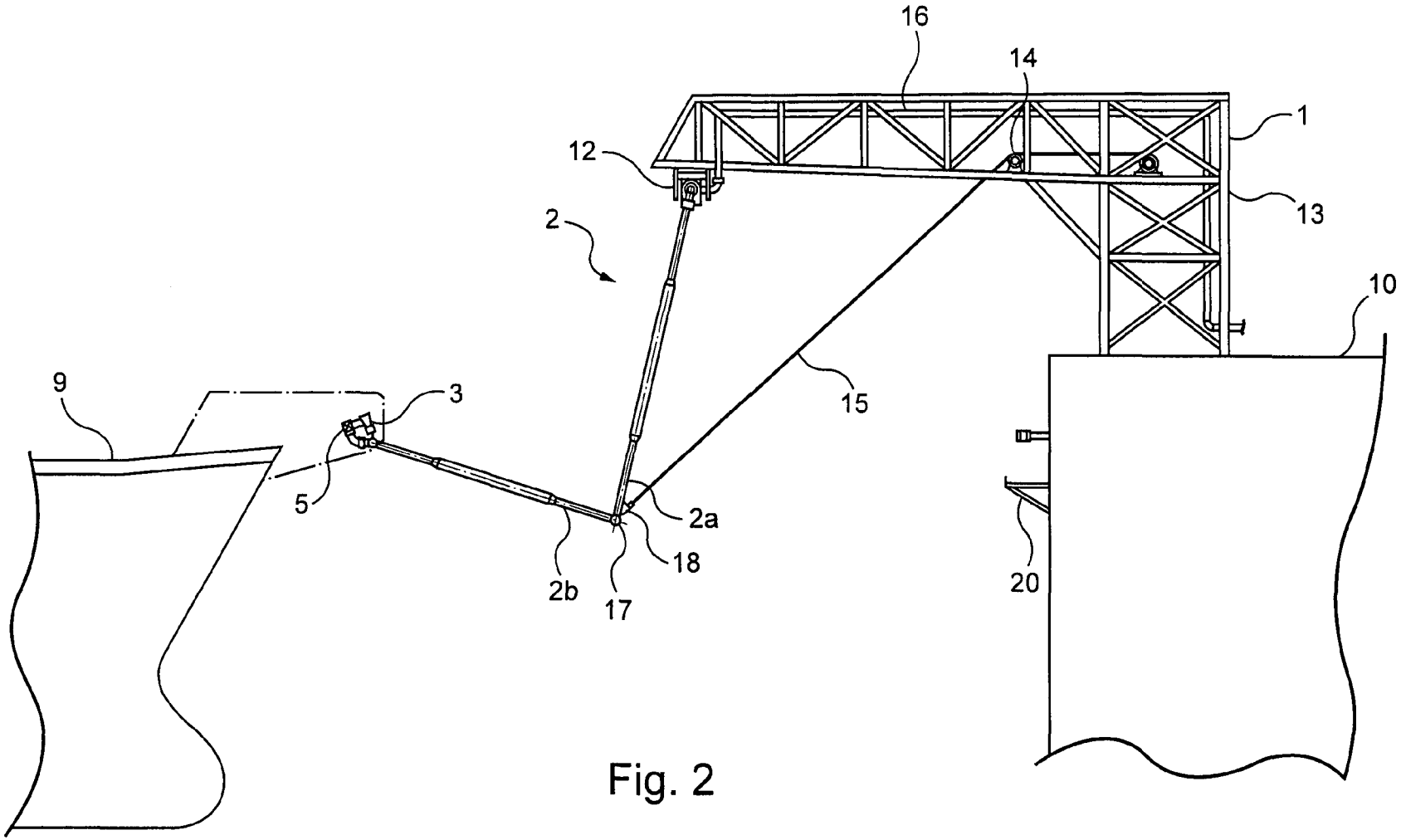

The system for transfer of a fluid product, here liquefied natural gas, between two ships, as represented in FIGS. 1 and 2 comprises a metal support structure fixed onto a first ship 10, such as an FPSO, and which bears at the end of a horizontal support arm 1 three assemblies of three double rotary joints, also known in the trade by the name of "rotations" 12, described in more detail below. This structure also supports winches 13, here 3, for maneuvering the inner segment 2*a* of each of three tubular arrangements 2 for conveying the fluid product, deflecting pulleys 14 for each of the cables 15 wound on the winches 13, as well as the sets of piping 16 connected to the piping network of the first ship 10. It will be noted that the maneuvering winches 13 are placed away in the structure to reduce the overhanging load and to facilitate access for maintenance.

The support arm 1 extends here substantially perpendicularly to the vertical support of the support structure that carries it.

The inner segment 2*a* of each tubular arrangement 2 comprises a rigid duct, typically of 16" diameter (1 inch=2.54 cm) and is reinforced here at its center by the use of wider tubing (20" or even 24"), or, as a variant, by the choice of specific materials, in order to ensure the rigidity of the system. Other types of reinforcement are of course possible.

Each inner segment 2*a* is connected to an assembly of three rotary joints 12 on the same side as the support structure and to an outer segment 2*b* of tubular arrangement 2 by two elbows and one rotary joint 17, an anchorage point 18 for the maneuvering cable 15 being situated near the latter rotary joint.

The outer segment 2*b* of each tubular arrangement 2 is formed according to the same principle as the inner segment 2*a*. At the end of that segment 2*b*, an assembly of three rotary joints 30 is connected to a safety valve 5 terminating the assembly (see FIG. 3). The safety valve is also connected to a centering cone 3 adapted to make good the alignment of the segments for final connection.

In FIG. 1 the resting position of the transfer system is also represented. This position enables the outer segment 2*b* of the system to be rigidly fixed, which is imperative to ensure optimum safety in case of a storm as well as during maintenance operations. A maintenance platform 20 of the ship 10 enables access to the vital components to perform any repairs.

In practice, in this resting position, which is original per se (that is to say that it may in particular be envisaged independently of the first and second means defined above), the outer segment 2*b* extends downwardly from the support structure, here vertically, in order to be easily accessible from the deck of the ship 10, and more particularly its platform 20, whereas the inner segment 2*a* extends along the support arm 1, that is to say here horizontally, and thus at a right angle to the outer segment 2*b*.

Figure 3:
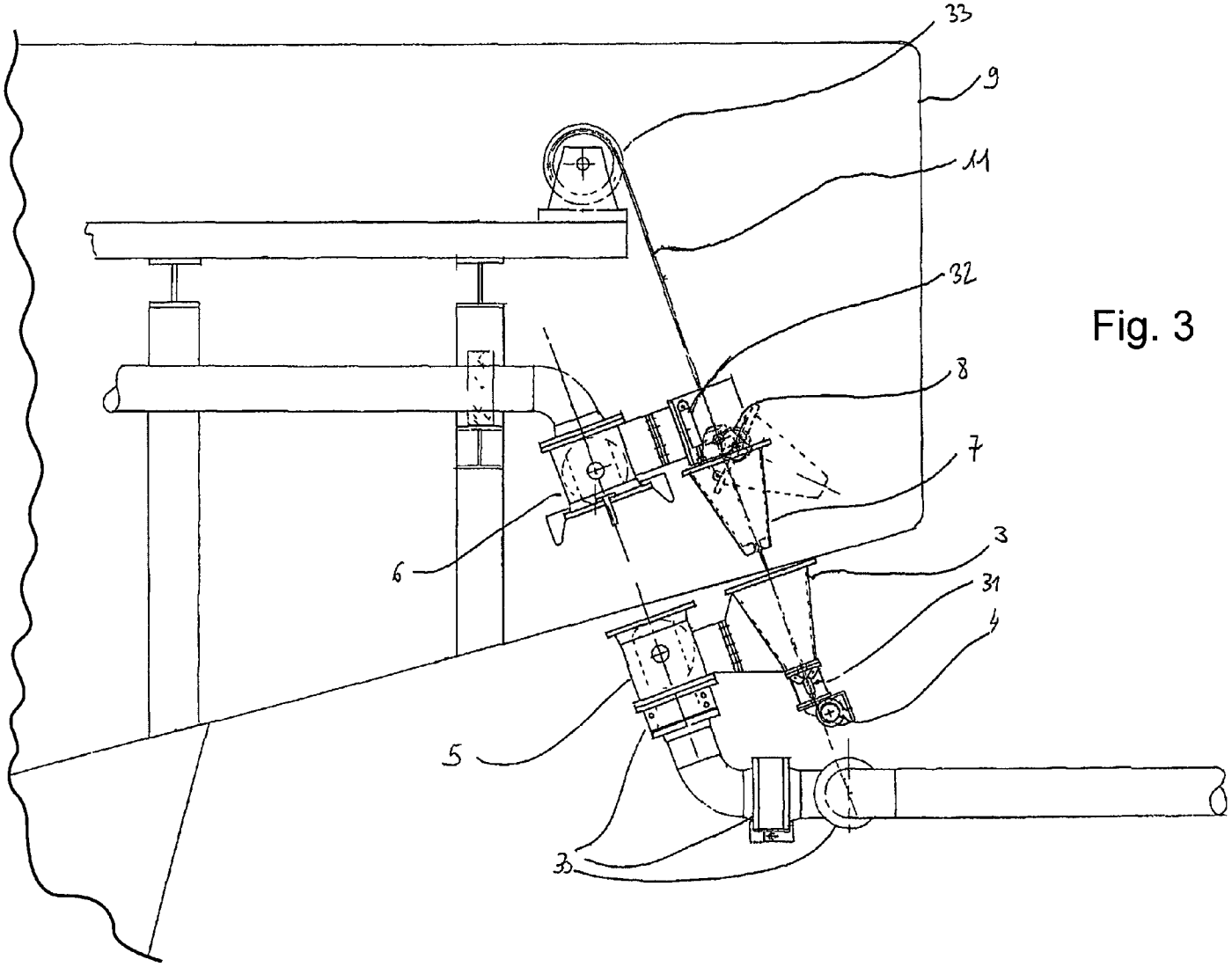
FIG. 3 is a diagrammatic view in elevation illustrating the members installed at the end of the tubular arrangements and on the ship in tandem.

The second ship, here an LNG-C, enables the connection of each hinged tubular arrangement 2 using a coupling means, here a valve/coupler 6 equipped with a male centering cone 7 and an acquisition winch 33 installed forward of the bow (see FIG. 3). This loading device permits a safety distance of approximately 60 m between the two ships and provides for the connection and the transfer of the fluid product under sea conditions specific to each production site. In practice, the second ship 9 is held along the axis of the first ship 10 by two hawsers 26 disposed on respective opposite sides of the bow of ship 9 and which are fixed to the rear of the first ship 10.

The connection members provided at the end of the tubular arrangements 2, and the connection members provided on the second ship 9 for its loading, are represented in more detail in FIG. 3.

More particularly, regarding the members installed on each outer segment 2*b*, an assembly of three rotary joints 30, permitting rolling, pitching and yawing movements of ship 9, and which is connected to the first ship 10, ends with a plug valve 5 adapted to isolate the transfer system at the end of the gas transfer. The intermediate rotary joint of this assembly is equipped with a device limiting the rotation angle to +/−5° in order to avoid the valve/cone assembly tipping in certain conditions of maneuver. Moreover, the axis of this valve 5 is, here, inclined at approximately 20° relative to the vertical formed by the axis of the outer segment 2*b* so as to lie along the natural axis of movement if the outer segment 2*b* in the final phase of connection.

The centering cone 3 is equipped with a device 31 for locking an acquisition cable 11 coming from the second ship 9 and a winch 4 making it possible to pull a rope connected to the acquisition cable in order to draw that cable into locking position.

It will be noted that this winch may also be independent from the centering cone by being, for example, installed on a fixed structure situated in the vicinity of the resting position for storage of the tubular arrangement 2, to provide the same function.

As regards the members installed on the bow of the second ship 9 linked in tandem, an assembly of equipment is provided for each articulated tubular arrangement 2.

This assembly comprises a downwardly oriented valve coupler 6 of which the axis is inclined at approximately 20° in order to adapt to the duct of the valve 5 to be connected. This coupler 6 is equipped with a conventional emergency release system (known in the art by the acronym ERS).

Fastened to this coupler 6 or fixed to a parallel structure is a male cone 7 which enables the two ducts to connect to be aligned before closure of the coupler. This cone 7, here, may be oriented to enable it to be aligned with the acquisition cable 11 in the intermediate connection phase described below. A guide pulley 8 for this cable and a maneuvering jack 32 are integrated into this member.

The acquisition winch 33 with its cable 11 is installed along the axis of the centering cone 7. This winch is of the constant rotation type. By virtue of the present invention, the tension of cable 11 is, as a matter of fact, continuously maintained by the weight of the tubular arrangement to connect, whatever the movements of the ships.

Figure 4:
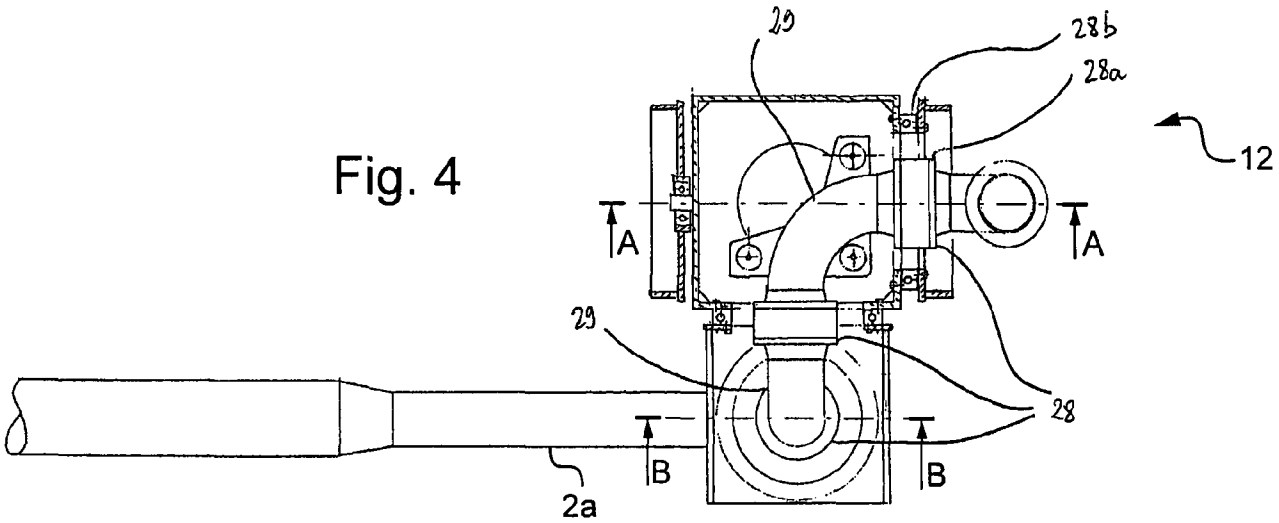
FIGS. 4 and 5 are diagrammatic views of the three rotary joints installed at the end of the support structure, FIG. 4 being a view from above on the section plane CC of FIG. 5, whereas the latter is an elevation view on the section planes AA and BB of FIG. 4.
Figure 5:
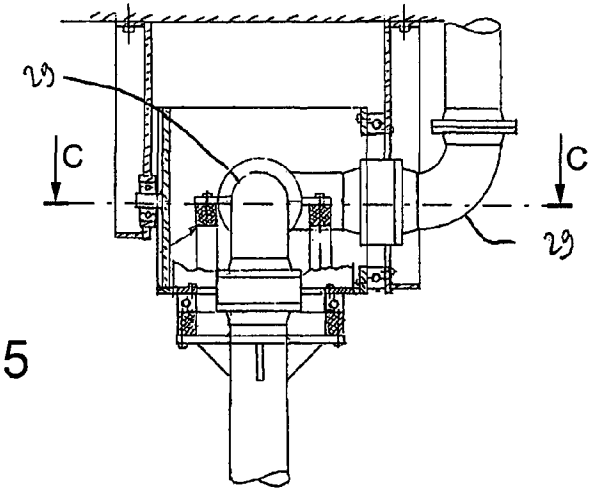

In FIGS. 4 and 5 a representation is provided in more detail of one of the assemblies 12 of three double rotary joints 28 adapted to enable the movements of the support structure in three planes (sway, surge, heave).

Each of these rotary joint is double, i.e. one product rotary joint 28*a* doubled up by a purely mechanical rotary joint 28*b*.

To objective of this configuration is to free the product rotary joint from the mechanical stresses of the system and to enable access to the seals of the product rotary joints by demounting only one cone of the duct (while maintaining the integrity of the assembly).

Reference may also be made to the patent application WO 0066484 mentioned above, for more detail on the subject of the structure of such double rotary joint assemblies.

Figure 7:
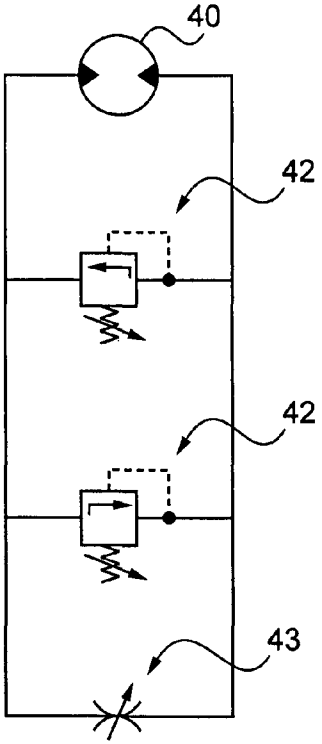
FIGS. 6 and 7 are very diagrammatic views representing an oscillation damping system example.
Figure 6:
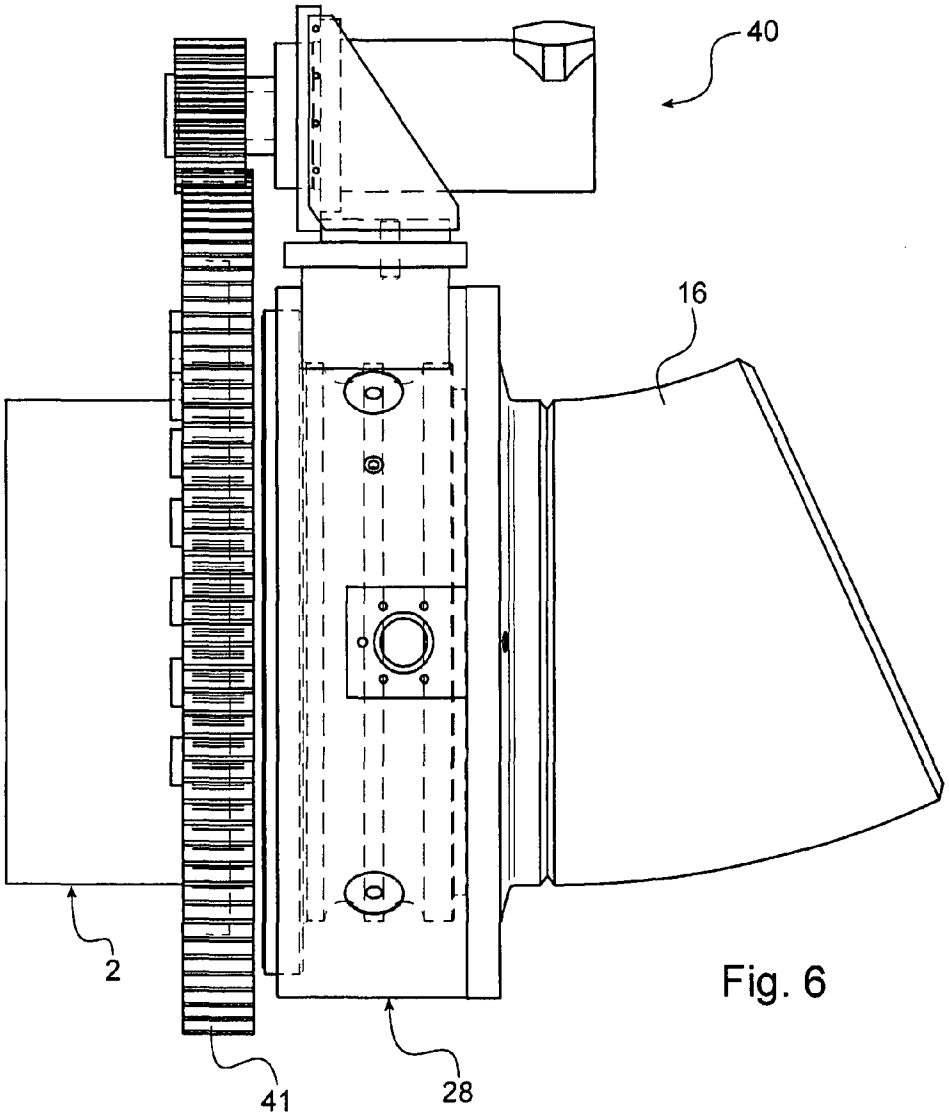

FIGS. 6 and 7 illustrate an example of a system for damping oscillations based on a hydraulic motor coupled with a throughput limiter enabling oscillations to be damped.

Therefore, the number of rotary joints per articulated tubular arrangement 2 is six. The addition of a rotary joint enables the loads in the rotary joint and in the tubes to be considerably reduced and to avoid reinforcement (beyond what is provided for above, cf. description of FIGS. 1 and 2) of the inner and outer segments 2*a* and 2*b*. In the case of a tubular arrangement 2 comprising seven rotary joints, a mechanical system must be provided in order to attenuate the oscillations thereof induced by the respective movements of the two ships.

As regards its mechanical part (FIG. 6), this system comprises a ring gear 41 on a mobile part of a rotary joint 28 of the assembly 12 and a hydraulic motor with a pinion 40 fixed to the fixing part of the rotary joint. When the piping of the arrangement shifts further to movements of one or both ships, the ring gear 41 also shifts (the ring gear is mechanically linked to the piping) and rotationally drives the hydraulic motor 40.

The hydraulic diagram is represented in FIG. 7.

More particularly, when the hydraulic motor 40 is rotationally driven by the ring gear 41, the oil passes via the flow limiter 43 which brakes the oil, so enabling the speed of rotation of the motor, and thus that of the ring gear, to be braked so enabling the oscillations to be damped. Pressure limiters 42 enable excessive pressure to be avoided in case of oscillations that are too great.

Other components, such as hydraulic oil coolers, may be added by the person skilled in the art, in particular depending on the applications.

Figure 8:
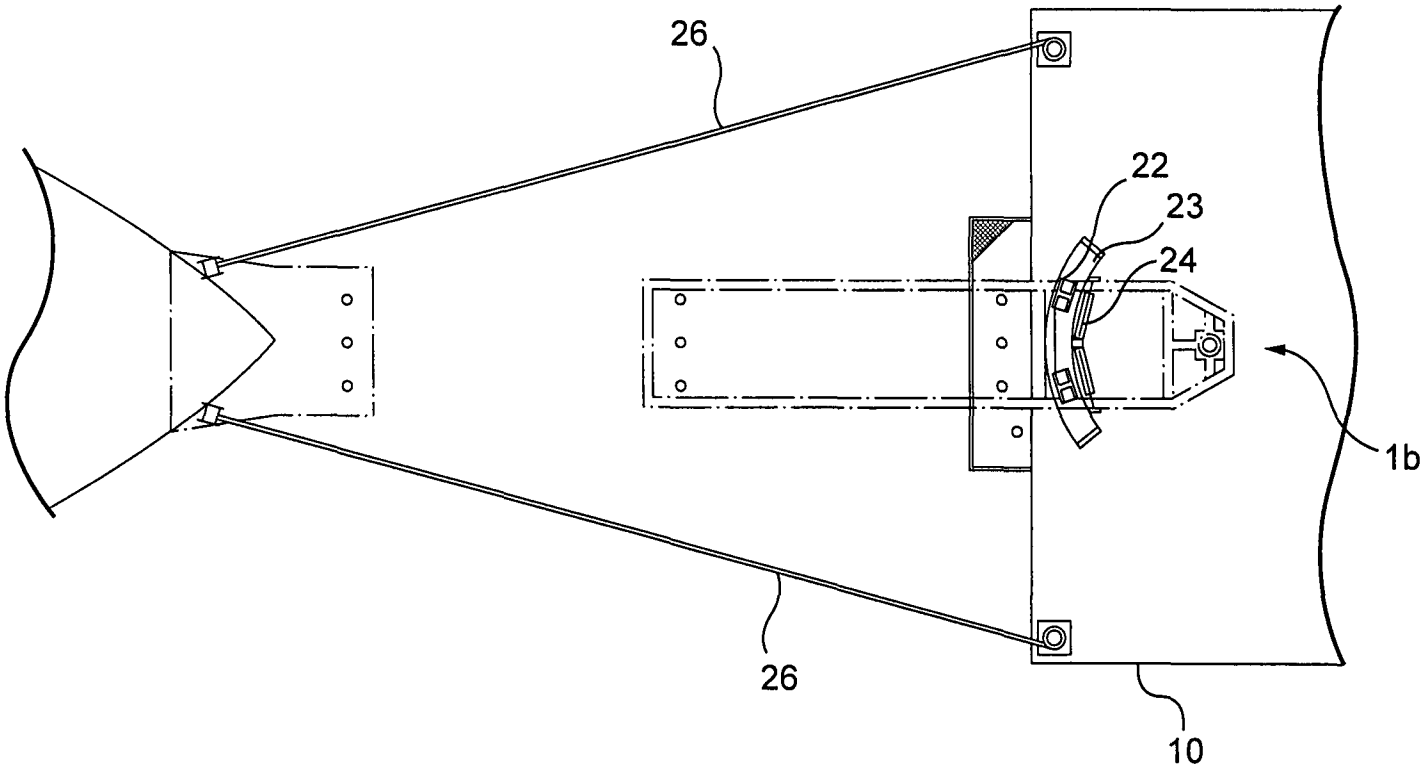
FIGS. 8 to 10 are similar views to FIGS. 1 and 2 and represent variant embodiments of the transfer system.
Figure 9:
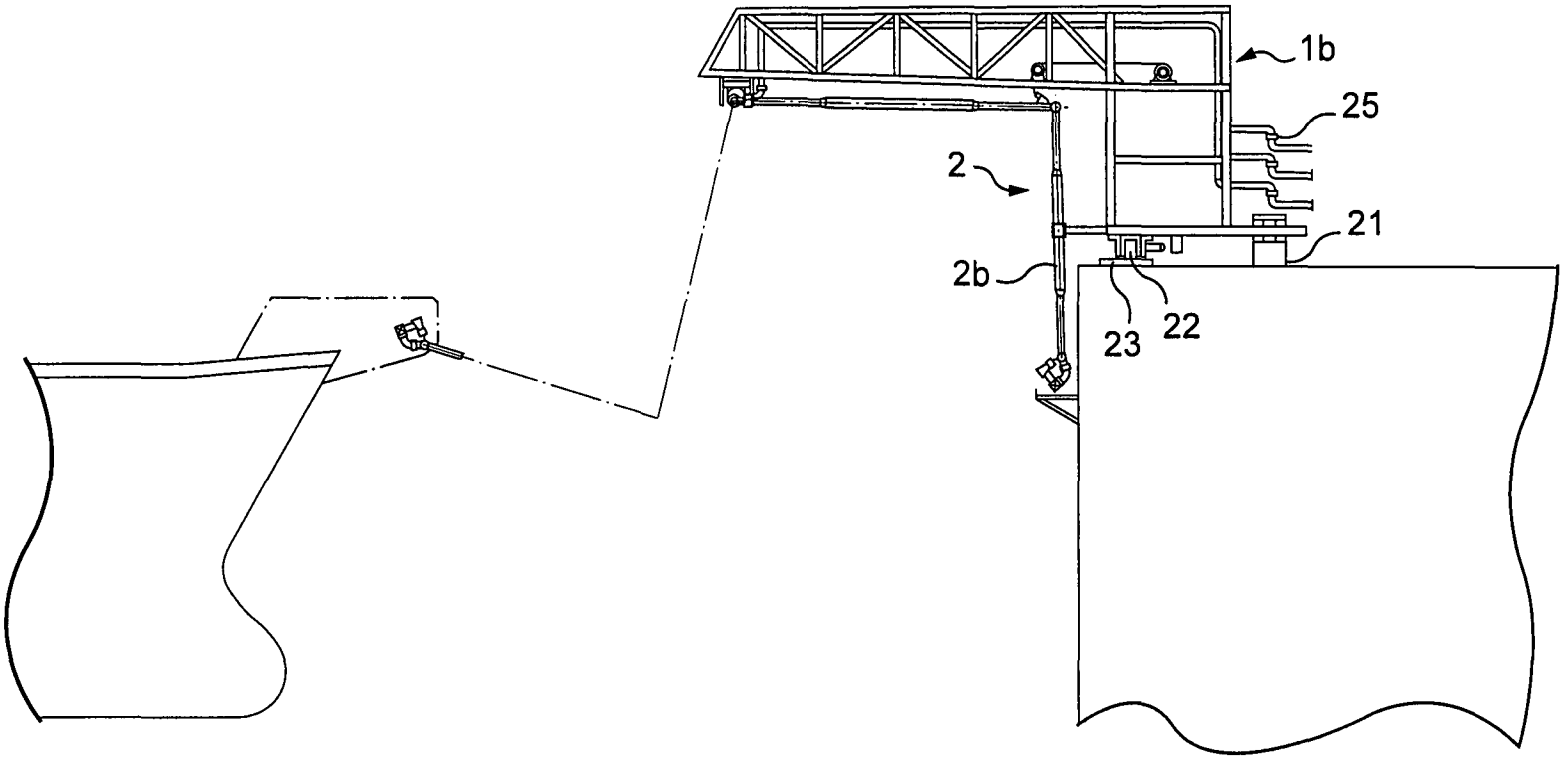

FIGS. 8 and 9 illustrate a variant of the system comprising a support structure 1*b* that can rotate relative to a pivot anchored to the first ship 10. This variant enables the working zone of the transfer system to be adapted to relatively large movements (in particular in terms of sway) of the second ship 9 in difficult sea conditions such as those in which currents and winds may have variable and crossed orientations.

To enable the rotation of structure 1*b*, a pivot 21 fixed to the first ship 10 is the center of rotation and a set of set of rollers 22 disposed on a rolling track 23 bears the weight of that structure 1*b* while enabling its rotation. Two hydraulic jacks 24 control that rotation to adapt the position of the structure to the movement of the second ship 9, so enabling the working zone of the transfer system to be enlarged. The zone of coverage is, in practice, directly defined by the type of mooring defined for the application.

Rotary joints 25 in which flows the fluid product are also installed on the connection piping. They are disposed along a vertical axis, as FIG. 9 shows.

Moreover, as the support structure 1*b* is rotary, the tubular arrangement 2 is retained in resting position by a link from its outer segment 2*b* directly to the support structure 1*b* (see FIG. 9).

In the embodiments represented in FIGS. 1, 2, 8 and 9, the second ship 9 is held along the axis of the first ship 10 by two hawsers 26 disposed one on each side of the bow, and fixed to the rear of the first ship 10. This configuration avoids any interference between the transfer system (tubular arrangement 2) and the supporting hawsers of the second ship 9.

Figure 10:
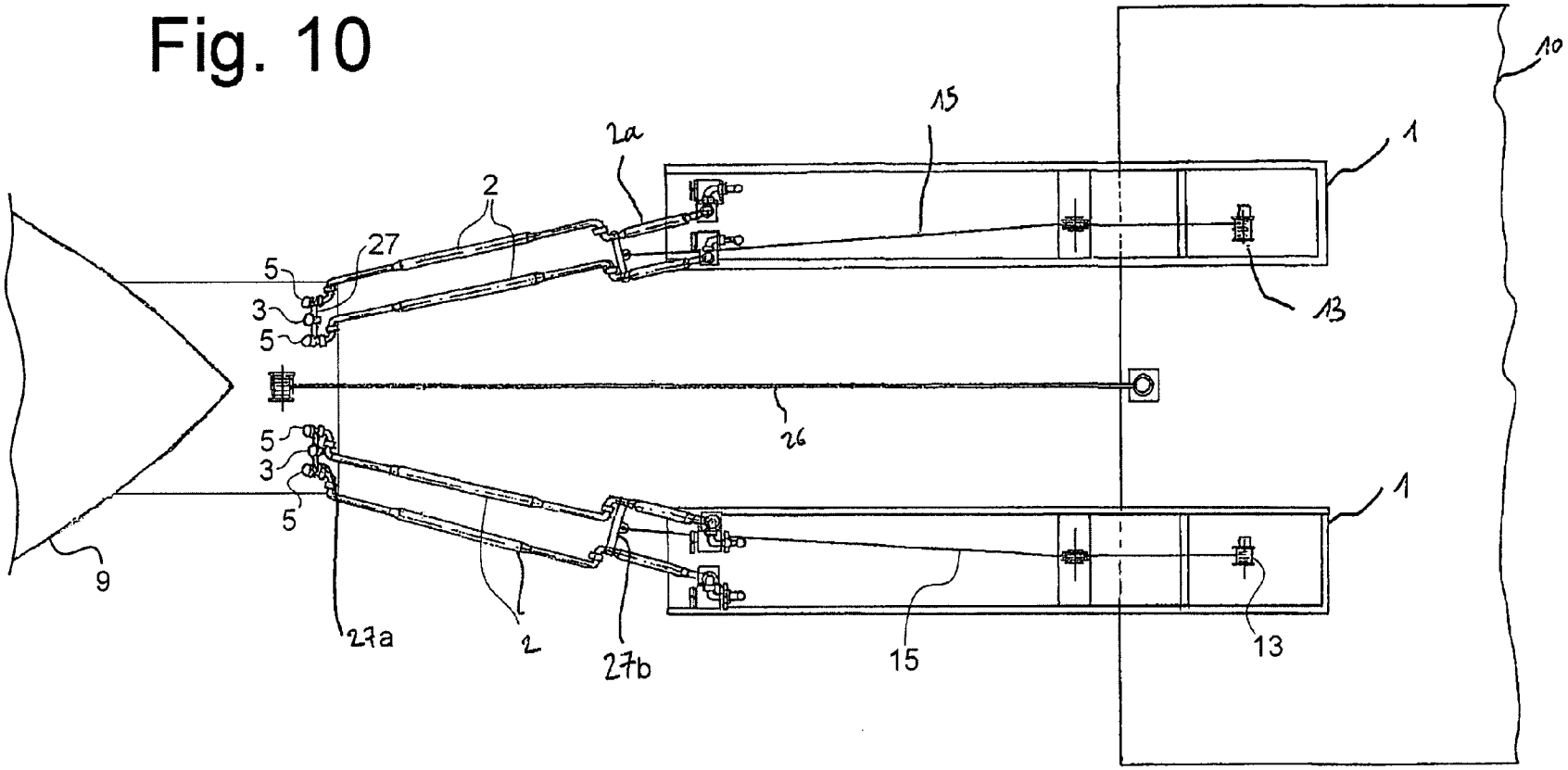

In case a single hawser 26 disposed along the axis of the stern of the second ship 9 is used, a variant detailed in FIG. 10 may be used.

Two structures 1 fixed parallel support the tubular loading arrangement which, in this version, is double for each structure and which cannot have any interference with the central hawser in case of drift of the second ship 9 within predetermined limits.

A rigid link 27*a* is also represented in this variant between the two end valves 5, and on which a single centering cone 3 makes it possible to guide two articulated tubular arrangements 2 which are mechanically associated.

On the rotary joints that are intermediate between the inner and outer segments 2*a* and 2*b*, another articulated mechanical link 27*b* enables a single cable 15 to be anchored, which is linked to the maneuvering winch 13.

An object of such a configuration is to simplify the connection maneuvers, while reducing the amount of equipment necessary (winches, centering cones).

Figure 11:
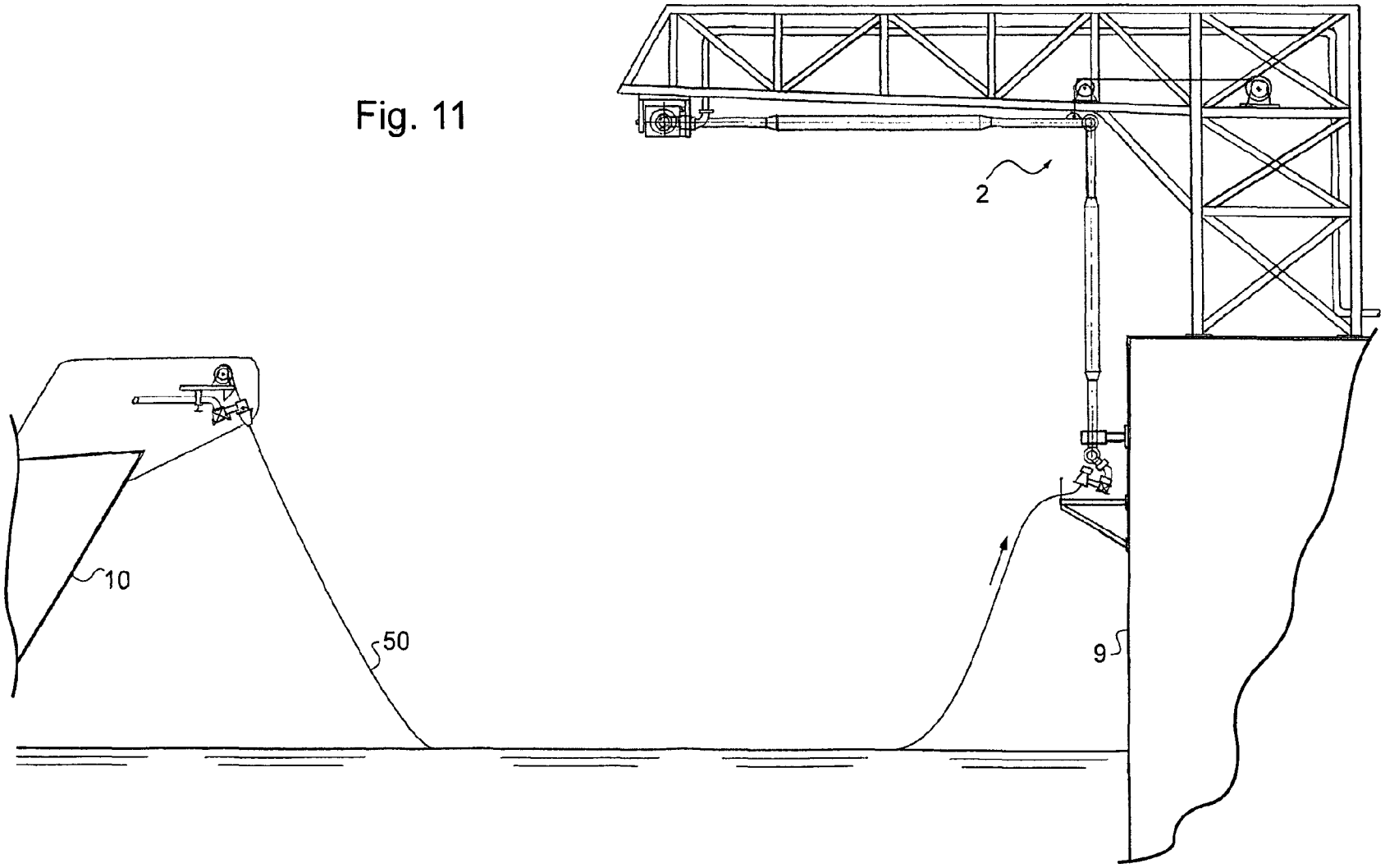
FIGS. 11 to 15 illustrate an example of an operating procedure for connection of the transfer system in five steps.
Figure 12:
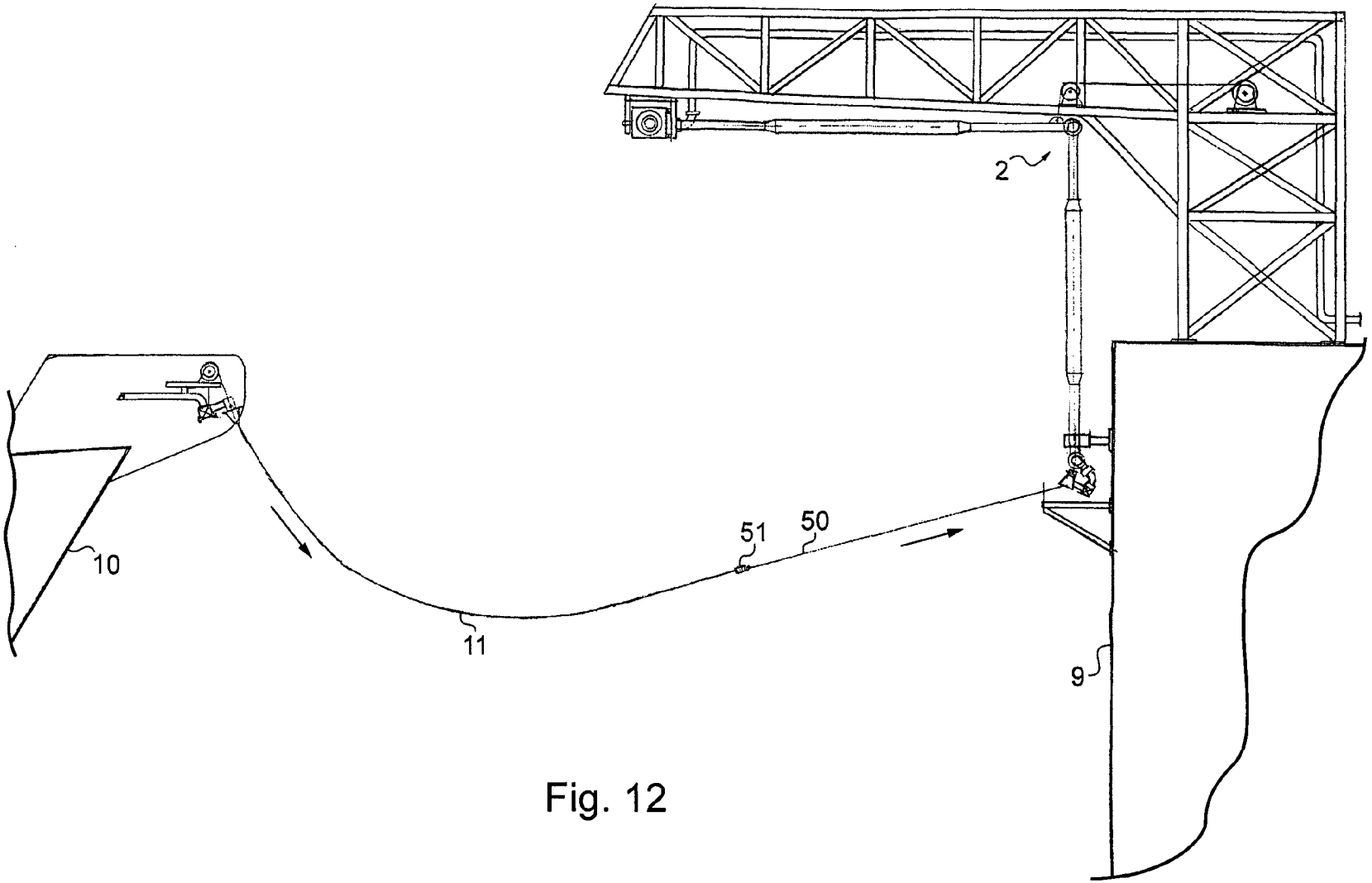
Figure 13:
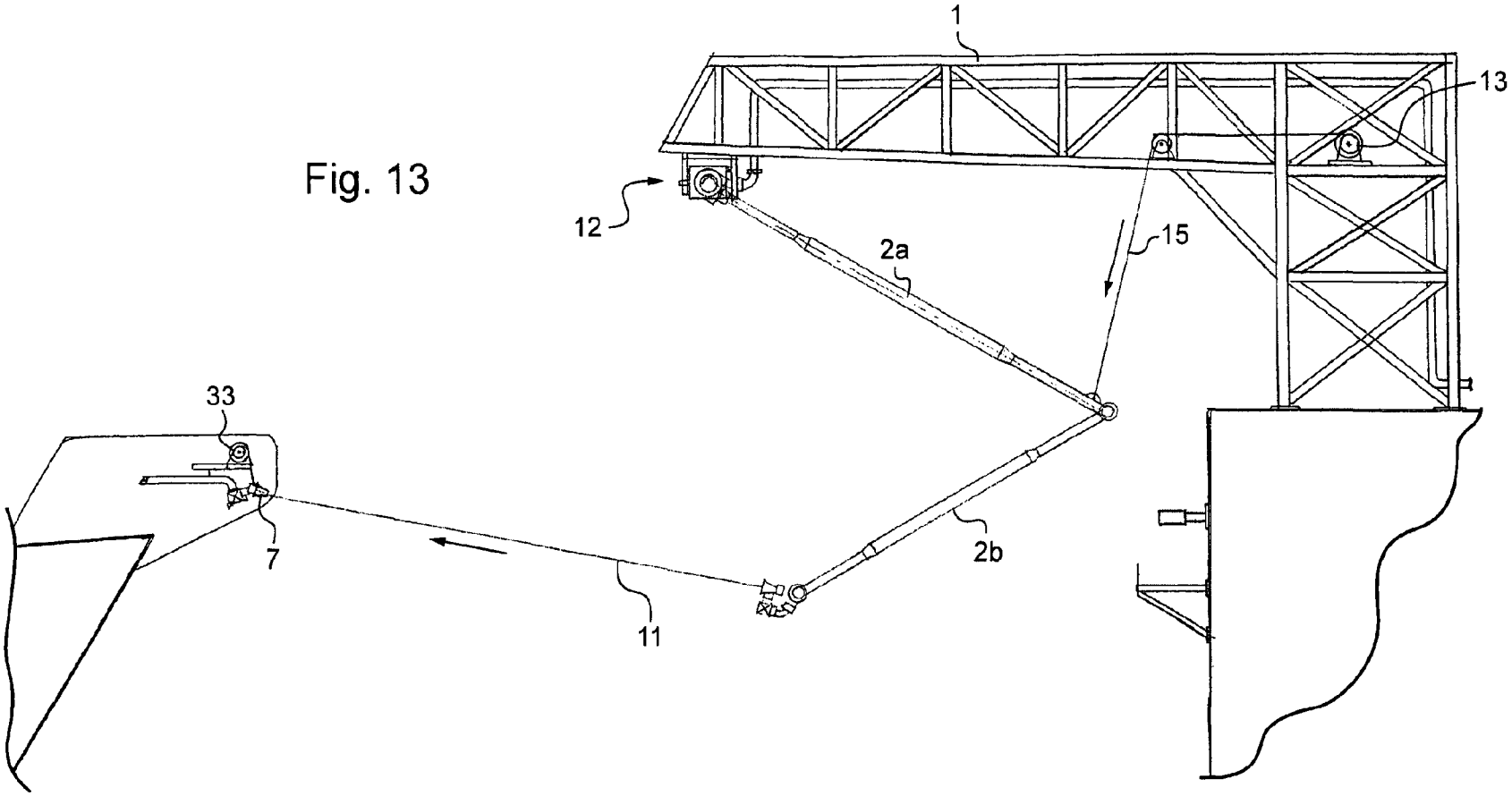
Figure 14:
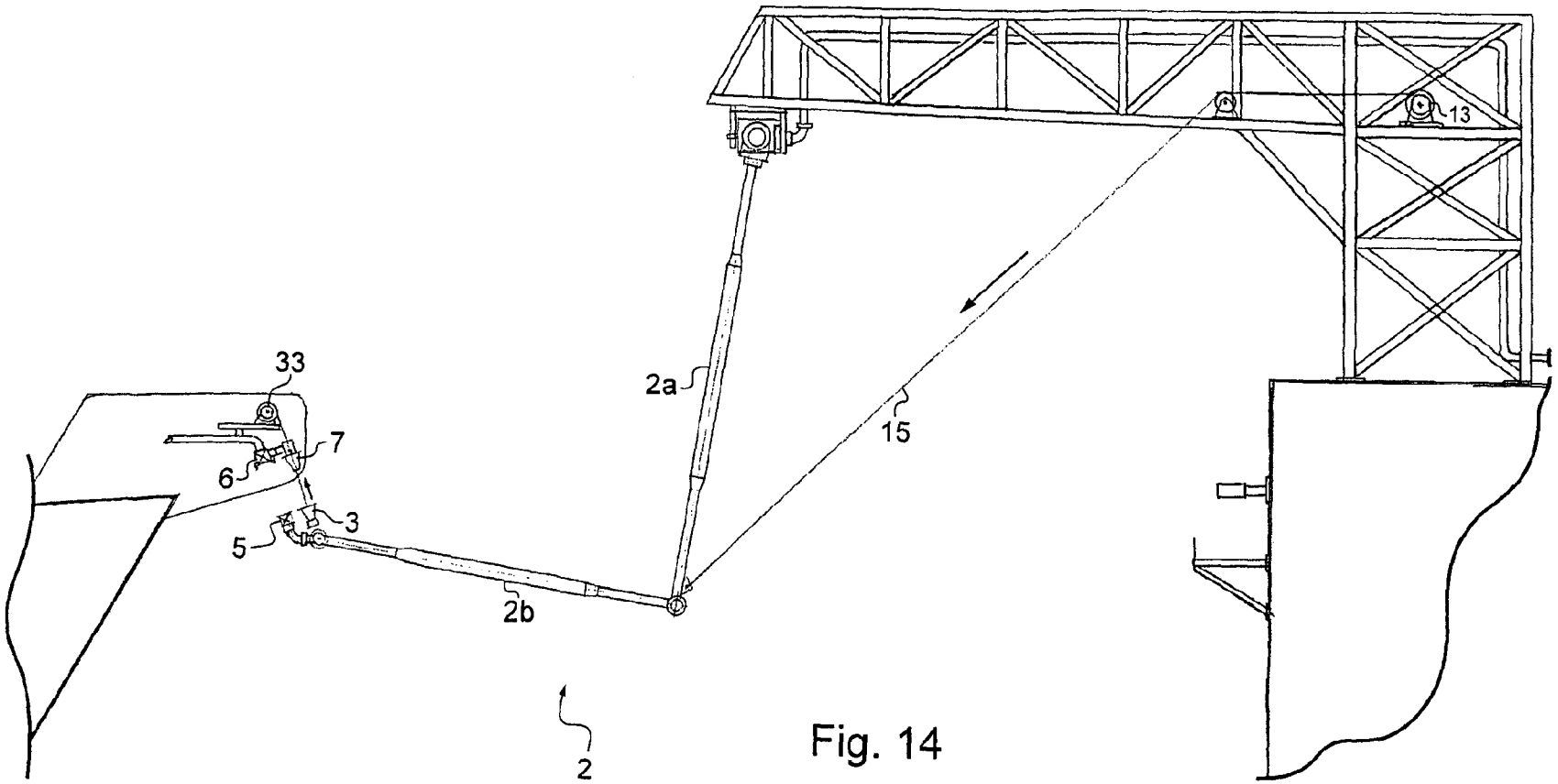
Figure 15:
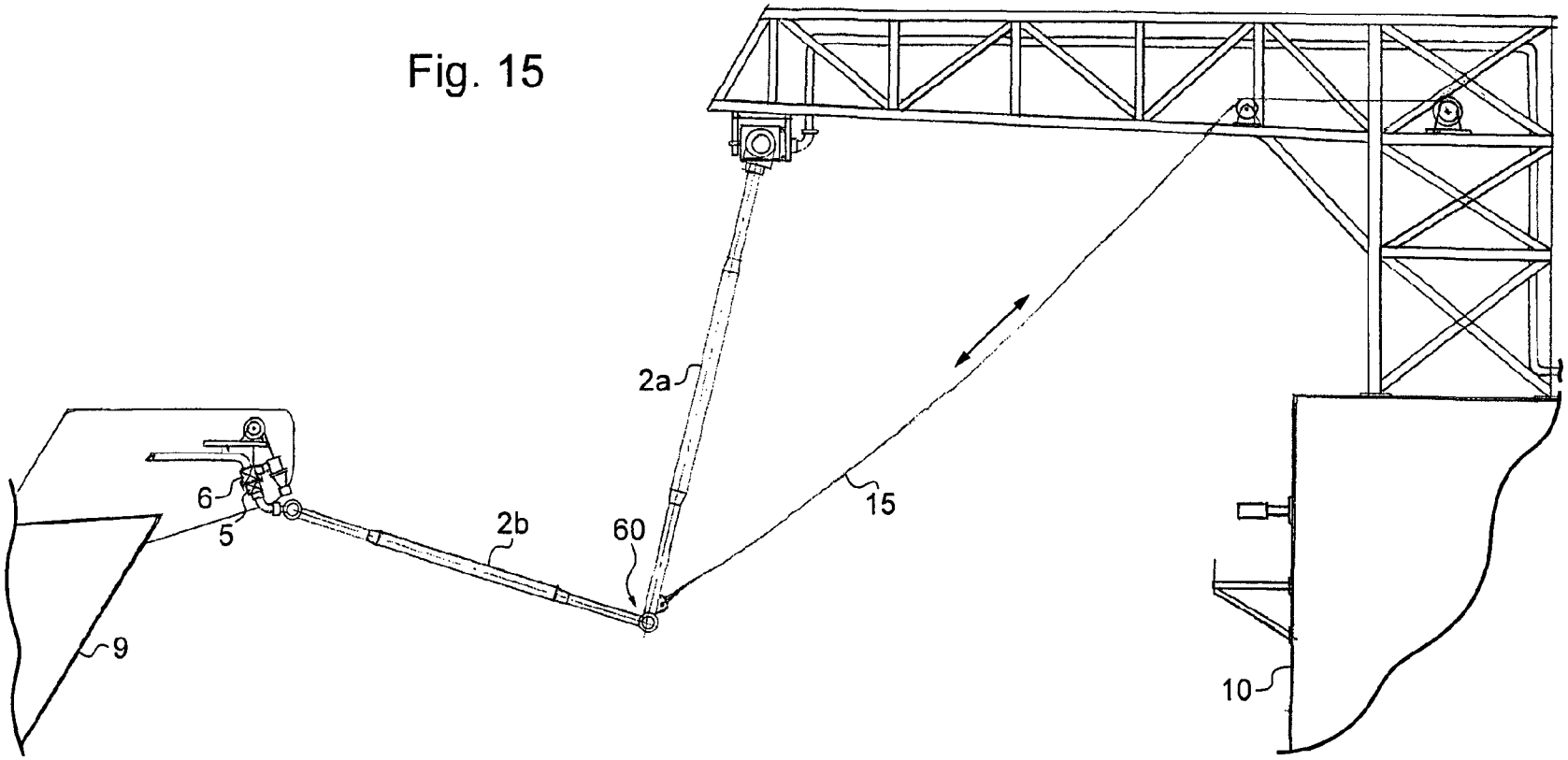

To connect a tubular arrangement 2, the following steps may be implemented:

- an operative situated on second ship 9 throws a rope (or steel lanyard) 50 linked to the acquisition cable 11 to an operative situated on the first ship 10, (see FIG. 11) in order for the latter to be able to connect it to the winch 4;
- the winch 4 as well as the acquisition winch 33 are started (winch 33 unwinding) to bring a cable socket 51 linking cable 11 and rope 50, and thereby the cable 11 itself, to the female centering cone 3 for the purpose of locking that cable socket 51 using a locking device 31 (see FIG. 12);
- the maneuvering winch 13 is actuated to unwind so as to make the inner segment 2*a* pivot relative to the support arm 1 by virtue of the assembly 12, for the purpose of lowering its end by which it is connected to the outer segment 2*b*, from its storage position on the same side as the support arm 1 (see FIG. 13). In practice, a movement the general path of which is a circle arc is imparted to that end which, at the end of the procedure, exceeds 90°;

actuate the acquisition winch 33 so as to pull up (and therefore move forward) the coupling end of the outer segment 2*b* adapted to be linked to the coupling means situated on the second ship 9, for it to be connected to that coupling means, from underneath (see also FIG. 13), the coordination of the operation of the winches, which is ensured by an operative, enabling the aforesaid movements to be obtained, and the male centering cone 7 being oriented so as to be aligned with the acquisition cable 11. During these movements, the outer segment 2*b* is caused to pivot relative to the inner segment 2*a* about their common articulation in the direction of closure of the compass formed by those two segments. Its free end is, here, also lowered, over a part of its path, relative to its storage position;

at the end of connection of the tubular arrangement 2 (see FIG. 14), the male centering cone 7 is substantially locked in connection position, that is to say that its axis is substantially parallel to that of the valve/coupler 6, while the winches are still actuated in accordance with the preceding step;

Once the end valve 5 has been connected to the valve/coupler 6, the transfer of the fluid product may take place (see FIG. 15). In this connection position, the inner and outer segments 2*a* and 2*b* each form an angle other than zero respectively to the vertical and the horizontal and a small tension is maintained in the cable 15 to avoid the latter tangling or dipping into the water.

End of travel switches may be set up at the articulation in the inner and outer segments 2*a* and 2*b* (at 60, see FIG. 15) to limit the angular travel between those segments, in particular when the actuation of the maneuvering and acquisition winches is not carried out in synchronization.

The disconnection procedure uses the same logic, in a reverse sequence.

Figure 16:
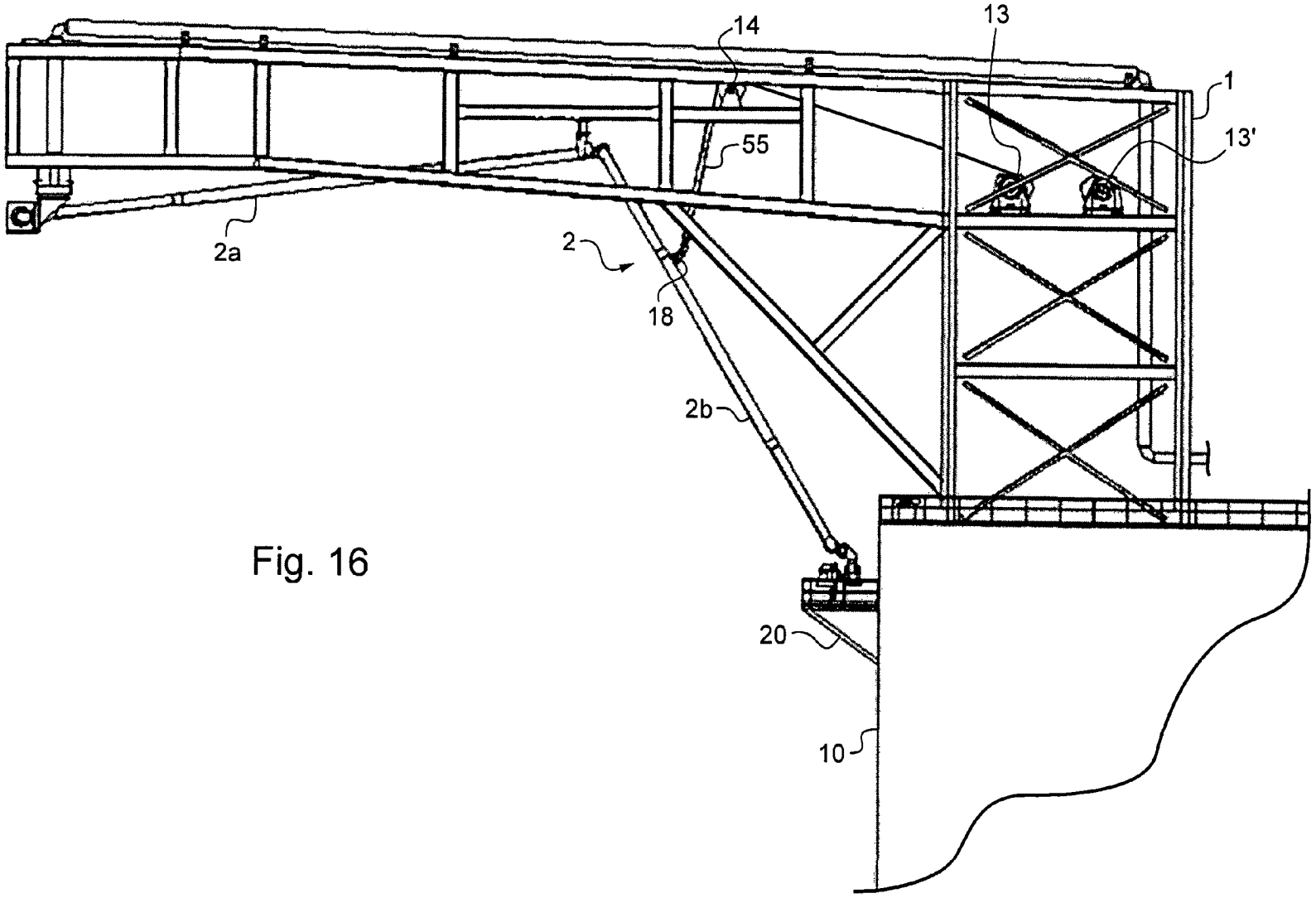
FIG. 16 is a diagrammatic view in elevation similar to FIG. 2 and represents another variant embodiment of the transfer system.

As may be seen in FIG. 16, for larger transfer systems than those represented in the preceding Figures, the anchorage point 18 is offset on the outer segment 2*b* to enable the complete assembly of the tubular arrangement 2 to be brought back into stored position (the anchorage point on the inner segment 2*a* is replaced by an abutment).

In this position, the inner and outer segments 2*a* and 2*b* of each tubular arrangement 2 (of which there are three in the case of this variant, linked mechanically and sharing a common centering cone) form an angle greater than 90° here.

A rigid bar 55 is furthermore provided here as an extension to the cable to better control the trajectory thereof during the maneuvering of the system.

Furthermore, a second maneuvering winch 13' is provided to replace winch 13 in case of failure.

The present invention, as it has just been described, more generally possesses the following particularities and advantages:

a. The concept of articulated links (tubular arms) connected to the ship in tandem from below, does not require balancing nor any constant tension winch to avoid shocks at the time of connection, reducing in particular the consumption of electricity. To be precise, the weight of the system keeps the acquisition cable in continuous tension whatever the movements of the ship. The separation between the two elements to connect is maintained until the final connection. The use of the system's own weight to produce the maneuver is remarkable compared to the other solutions cited from the state of the art.

b. The metal structure installed on the stern of the production ship is of reduced size and is generally fixed. Exceptionally, it may be rotatable to provide a greater working zone according to the type of mooring adopted.

c. The articulated tubing (tubular arrangements) destined for the transfer of fluids are independent to enable redundancy in case of failure. In the case of LNG, their minimum number of two (liquid+gas) may be increased to 3 or 4 to provide a higher throughput and reduce the loading time. They may also be mechanically associated together to reduce the maneuvering time during the connection/disconnection operations (to maintain the redundancy, they may be rapidly dissociated).

d. The system provided to attenuate the oscillations and which comprises a hydraulic motor shearing the oil to generate damping, may be replaced by a hydraulic jack, a gas strut or any other system enabling damping to be produced. It should also be noted that the articulated tubing may be linked together to limit or even cancel the consequences of such oscillations.

e. The equipment destined for the connection of the ship in tandem is reduced to the maximum extent (valve/coupler and winch), in order to reduce the maintenance. No specific rotary joint nor sophisticated mechanical system.

f. Due to its design, the system enables easy drainage of the product line at the end of the loading, by pressurization of the remaining LNG via a spur situated at the low point of the product line adjacent the rotary joint 17 between the inner and outer segments 2*a* and 2*b*.

g. This system provides very good performance in terms of throughput, up to 5000 $m^3/h$ of LNG for each line transporting the liquid, and very low losses of load thanks to the lack of roughness inside the rigid tubes. Flexible hoses, such as cryogenic hoses, may however be used.

h. All stiff tubing provided is dimensioned for a life of 20 years minimum, or even 25 years and only requires regular maintenance operations without replacement of the whole product line element.

i. The acquisition winch may be situated on the tubular arrangement if desired; the winches and the cables may more generally be replaced by equivalent mechanical means known to the person skilled in the art.

Of course, the present invention is not limited to the embodiments described and shown, but encompasses any variant embodiment and/or combination of their various elements.

In particular, the coupling means may be a valve, whereas the second segment would then comprise a valve/coupler at its free end adapted to be connected to the valve.

The invention claimed is:

1. A system for transferring a fluid product between a first location and a second location, the system comprising:

at least two tubular arrangements through which the fluid is conveyed, the tubular arrangements being independent of each other and each tubular arrangement including at least first and second segments which each comprise first and second ends, the first and second segments of each tubular arrangement being articulated to each other at their first ends;

the second end of the first segment of each tubular arrangement being rotatably suspended by a corresponding assembly of three double rotary joints from a support arm which is installed at the first location, and the second end of the second segment of each tubular arrangement being connectable to a coupling means which is installed at the second location, said assembly of three double rotary joints comprising an assembly of three fluid rotary joints which is supported by an assembly of three mechanical rotary joints that is connected to the support arm, each mechanical rotary joint having a common axis of rotation with a corresponding fluid rotary joint;

the second segment of each tubular arrangement being provided at its second end with a corresponding assembly of three rotary joints, and the second segments of the two tubular arrangements being connected together by a rigid link which extends between the second ends of the second segments adjacent the assemblies of three rotary joints;

first means for turning each first segment relative to the support arm to thereby lower the first end of the first segment from a storage position on the support arm; and second means for connecting the second end of each second segment to the coupling means from underneath the coupling means by pulling the second end of the second segment upwards from the second location to the coupling means.

2. A transfer system according to claim 1, wherein the first and second segments each comprise rigid pipes.

3. A transfer system according to claim 1, wherein the first means comprises a first cable which is linked to the first end of the first segment and winding means for winding the first cable.

4. A transfer system according to claim 3, wherein the winding means for the first cable comprises a first winch which is mounted on the support arm.

5. A transfer system according to claim 3, wherein the second means comprises a second cable having a first end which is connected to the second end of the second segment and a second end which is wound around a winch.

6. The transfer system of claim 5, wherein the winch is positioned at the second location.

7. A transfer system according to claim 1, wherein the second means comprises a second cable which is linked to the second end of the second segment and winding means for winding the second cable.

8. A transfer system according to claim 7, wherein the winding means for the second cable comprises a second winch which is positioned at the second location.

9. A transfer system according to claim 1, wherein in the storage position of each tubular arrangement, the second segment is oriented such that its second end is situated proximate a base of a support structure for the support arm.

10. A transfer system according to claim 1, wherein the support arm is carried by a support structure which is adapted to pivot about a vertical axis.

11. A transfer system according to claim 1, wherein the second segment comprises a plug valve at its second end.

12. A transfer system according to claim 1, wherein each tubular arrangement comprises at least six rotary joints for enabling the movements of the tubular arrangement.

13. A transfer system according to claim 12, wherein each tubular arrangement comprises seven rotary joints and the transfer system further comprises means for damping oscillations of the rotary joints.

14. A transfer system according to claim 1, wherein the transfer system comprises a plurality of tubular arrangements which are arranged in parallel and suspended from the support arm.

15. A transfer system according to claim 1, wherein the first location comprises a production or re-liquefaction platform or ship and the second location comprises a transport ship.

16. A transfer system according to claim 1, wherein each tubular arrangement comprises a number of end of travel switches to limit the angular travel of the first and second segments relative to each other.

17. A transfer system according to claim 1, wherein the coupling means comprises means for fixing the second ends of the second segments to the second location.

18. A transfer system according to claim 17, wherein the second end of each second segment comprises a frusto-conical member, the coupling means comprises a complementary frusto-conical member, and the two frusto-conical members are adapted to nestingly fit together to define a relative position between the second end of the second segment and the coupling means.

19. A transfer system according to claim 1, wherein the coupling means comprises a valve/coupler.

20. A method for transferring a fluid product between a first location and a second location using a system comprising at least two tubular arrangements through which the fluid is conveyed, the tubular arrangements being independent of each other and each tubular arrangement including at least first and second segments which each comprise first and second ends, the first and second segments of each tubular arrangement being articulated to each other at their first ends, the second end of the first segment being rotatably suspended by a corresponding assembly of three double rotary joints from a support arm which is installed at the first location, and the second end of the second segment of each tubular arrangement being connectable to a coupling means which is installed at the second location, said assembly of three double rotary joints comprising an assembly of three fluid rotary joints which is supported by an assembly of three mechanical rotary joints that is connected to the support arm, each mechanical rotary joint having a common axis of rotation with a corresponding fluid rotary joint, the second segment of each tubular arrangement being provided at its second end with a corresponding assembly of three rotary joints, and the second segments of the two tubular arrangements being connected together by a rigid link which extends between the second ends of the second segments adjacent the assemblies of three rotary joints, the method comprising the steps of:

turning each first segment relative to the support arm to lower the first end of the first segment from a storage position on the support arm; and connecting the second end of each second segment to the coupling means from underneath the coupling means by pulling up the second end of the second segment from the second location.

* * * * *